United States Patent [19]

Kawamura et al.

[11] Patent Number: 4,715,725

[45] **Date of Patent: * Dec. 29, 1987**

[54] STEP MOTOR CONTROL MECHANISM FOR ELECTRONIC TIMEPIECE

[75] Inventors: Yoshikazu Kawamura; Minoru Hosokawa; Sakiho Okazaki; Hiroshi Ishii, all of Suwa, Japan

[73] Assignee: Seiko Epson Corporation, Japan

[ * ] Notice: The portion of the term of this patent subsequent to Jan. 25, 2000 has been disclaimed.

[21] Appl. No.: 860,404

[22] Filed: Jun. 25, 1986

Related U.S. Application Data

[63] Continuation of Ser. No. 742,832, Jun. 10, 1985, Pat. No. 4,599,005, which is a continuation of Ser. No. 430,292, Mar. 10, 1985, Pat. No. 4,522,507, which is a continuation of Ser. No. 133,046, Mar. 24, 1980, Pat. No. 4,370,065, which is a continuation of Ser. No. 839,867, Oct. 6, 1977, Pat. No. 4,212,156.

[30] Foreign Application Priority Data

Oct. 6, 1976 [JP] Japan ..... 51-120146

[51] Int. Cl.[4] ..... G04F 5/00

[52] U.S. Cl. ..... 368/157; 318/696

[58] Field of Search ..... 368/76, 80, 155–157, 368/159, 160

[56] References Cited

U.S. PATENT DOCUMENTS

| | | | |
|---|---|---|---|
| 3,855,781 | 12/1974 | Chihara et al. | 368/159 |
| 4,032,827 | 6/1977 | Dobratz et al. | 368/159 |
| 4,114,364 | 9/1978 | Takahashi | 368/202 |
| 4,212,156 | 7/1980 | Kawamura et al. | 368/217 |

*Primary Examiner*—Vit W. Miska

*Attorney, Agent, or Firm*—Blum Kaplan

[57] ABSTRACT

A step motor driving control mechanism for use in an electronic timepiece for reducing the current consumption thereof is provided. Load detection circuitry detects the load condition of the step motor and selectively produces a load condition signal representative of a predetermined load condition thereof. Driving and control circuitry is provided for receiving a low frequency timekeeping signal produced by a divider circuit and a load detection signal when same is selectively produced by the load detection circuitry. In response to the presence or absence of a load detection signal applied thereto, the drive and control circuitry is adapted to vary the duration of the pulse width of a drive signal applied to the step motor to effect a driving of same.

2 Claims, 19 Drawing Figures

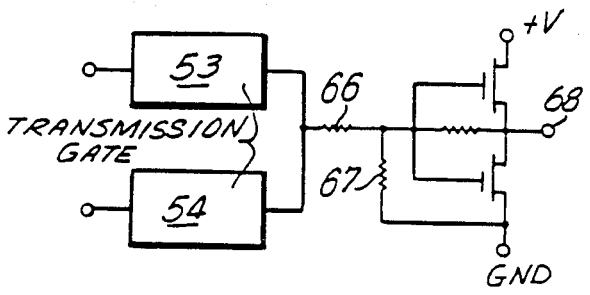
FIG. 13
FIG. 14
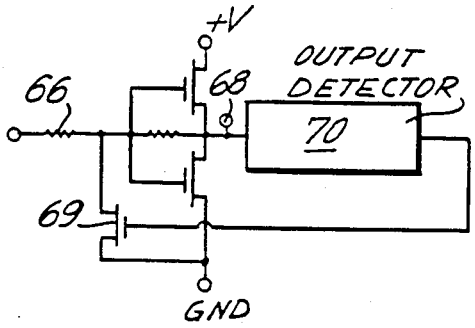
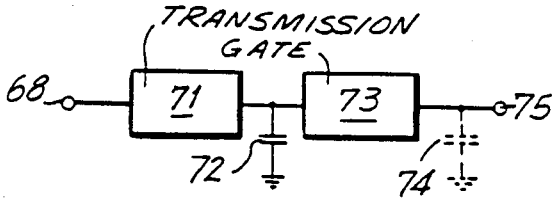
FIG. 15
FIG. 16
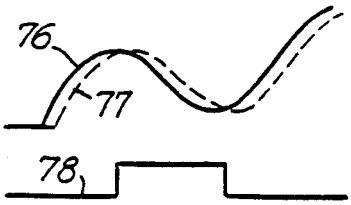

STEP MOTOR CONTROL MECHANISM FOR ELECTRONIC TIMEPIECE

This is a continuation of application Ser. No. 742,832, filed June 10, 1985, U.S. Pat. No. 4,599,005, which is a continuation of application Ser. No. 430,292, filed Mar. 10, 1985, now U.S. Pat. No. 4,522,507, which is continuation of application Ser. No. 133,046, filed Mar. 24, 1980, now U.S. Pat. No. 4,370,065, which is a continuation of parent application Ser. No. 839,867, filed Oct. 6, 1977, now U.S. Pat. No. 4,212,156.

BACKGROUND OF THE INVENTION

This invention relates generally to a step motor driving mechanism in an electronic timepiece, and in particular to a step motor driving control circuit for reducing the current required to drive a step motor by applying drive signals having a pulse width of a duration corresponding to the load placed on the step motor.

The widespread acceptance of electronic wristwatches, having electronic movements and utilizing a quartz crystal vibrator as a time standard is, in large measure, a result of extremely accurate timekeeping operation performed thereby, as well as the reliability offered by such wristwatches. One effort at improving the reliability of such timepieces has been directed to reducing the current consumption thereof, in order to reduce the rate at which the DC battery utilized to energize same is dissipated and thereby reduce the frequency with which the battery needs to be replaced.

Although the average power consumption of electronic wristwatches that were initially developed was on the orderof 20 $\mu$W, the average power consumption has been reduced to approximately 5 $\mu$W. Specifically, in the timekeeping circuitry which includes the oscillator circuit, divider circuit and control circuitry therefor, the average power consumption is 1.5 to 2.0 $\mu$W. The remaining power consumption occurs in the electro-mechanical converter of the electronic wristwatch and is on the average of 3 to 3.5 $\mu$W. Thus, the average power consumption resulting from the driving of the step motor, or other electro-mechanical converter, accounts for 60% to 70% of the entire power consumption of the electronic timepiece movement.

Although efforts have been made to reduce the power consumption of the electro-mechanical converter, these efforts have met with little success. Specifically, electro-mechanical converters have been developed that have a particularly high degree of efficiency, and hence the reduction in power consumption, if any, that will be gained from increasing the degree of efficiency of the electro-mechanical converter would be substantially insignificant. Moreover, the electro-mechanical converting mechanisms utilized in electronic wristwatches often consume additional power as a result of the inclusion of temperature, calendar and other environmental measurement mechanisms in the wristwatch. Also, an increase in power consumption results from vibration, shocks and other disturbances resulting from the normal use of the wristwatch. Accordingly, the electro-mechanical converting mechanism must be designed to effect driving of the gear train by the rotor under the worst operating conditions that can be anticipated.

For example, when a timepiece includes a calendar mechanism, an additional load is placed on the step motor four or five hours of the day with little, or no, additional load being placed on the step motor the remaining twenty or so hours of the day. In order to accommodate the calendar mechanism in the wristwatch, the electro-mechanical converter mechanism must be designed to drive the motor under the worst conditions, namely, when the calendar mechanism is being operated, thereby resulting in unnecessary power consumption occurring during the remaining twenty or so hours of the day. Accordingly, an electronic wristwatch, wherein the current consumption of the step motor is substantially reduced by varying the pulse width of the drive signal applied thereto in relation to the load condition placed on the step motor, is desired.

SUMMARY OF THE INVENTION

Generally speaking, in accordance with the invention, an electronic timepiece having a step motor for driving a gear train is provided. The timepiece includes a high frequency time standard for producing a high frequency time standard signal and a divider circuit for producing a low frequency timekeeping signal in response to said high frequency time standard signal being applied thereto. A gear train is driven by the step motor and is adapted to place the step motor in at least a first loaded condition, or a second loaded condition. A load detector is coupled to the step motor and is adapted to detect the loaded condition placed upon the step motor and, in response thereto, produced either a first load signal or second load signal in response to detecting either the first load condition or second load condition of the step motor. A driving and control circuit is disposed intermediate the dividing circuit and the step motor for receiving the low frequency timekeeping signal from the dividing circuit and either the first or second load signal produced by the load detector. The driving and control means, in response to the first load signal, is adapted to apply to the step motor a drive signal having a short pulse width and, in response to the second load signal, a drive signal having a pulse width of greater duration than said drive signal having a short pulse width.

Accordingly, it is an object of this invention to provide an improved small-sized electronic timepiece wherein the current required to drive the step motor is minimized.

A further object of the instant invention is to improve the power consumption of the electro-mechanical converting mechanism in an electronic wristwatch by reducing the power consumed in driving the electro-mechanical converter mechanism when the load placed thereon is reduced.

Still a further object of the instant invention is to provide electronic drive and control circuitry for applying a drive signal having a pulse width which varies in duration in response to the load placed upon the step motor.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 13 and 14 are circuit diagrams respectively depicting amplifier circuits for use in the peak detecting circuit depicted in FIG. 18;

FIG. 15 is a circuit diagram of a delay circuit of the type utilized in the peak detecting circuit depicted in FIG. 18;

FIG. 16 is a wave diagram illustrating the signals applied to the delay circuit depicted in FIG. 15;

DETAILED DESCRIPTION OF THE PREFERRED EMBODIMENTS

Figure 1:
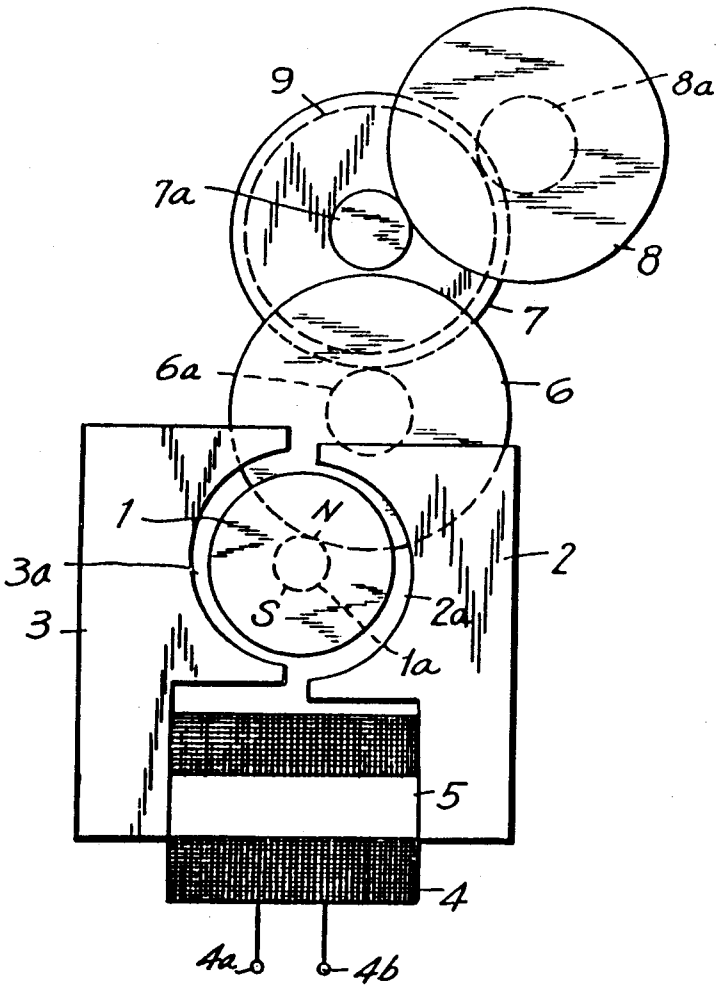
FIG. 1 PRIOR ART
FIG. 1 is a plan view of the electro-mechanical converter mechanism of an electronic wristwatch constructed in accordance with the prior art.

Reference is now made to FIG. 1, wherein an electromechanical converter mechanism, for converting the timekeeping signals produced in an electronic wristwatch into an incremental advancement of the gear train and constructed in accordance with the prior art, is depicted. The electro-mechanical converter mechanism includes a step motor comprised of an oppositely poled permanent magnet rotor 1 having two stator poles 2 and 3 disposed therearound, a stator yoke 5 connecting the respective stator poles, and a drive coil having terminals 4*a* and 4*b* surrounding the yoke. The portions of the stator poles 2*a* and 3*a* surrounding the permanent magnet rotor are coaxially offset with respect thereto in order to assure that the rotor is rotated in a predetermined rotational direction. Accordingly, the step motor is operated in a conventional manner by alternating the polarity of the stator poles, to thereby rotate the magnetic rotor through a 180° rotation in response to each change of polarity of the stator poles.

The polarity of the stator poles is alternately reversed in response to a drive signal being applied to terminals 4*a* and 4*b* of drive coil 4. The drive signal is produced by a conventional electronic timepiece movement of the type illustrated in FIG. 2. Specifically, a high frequency time standard, such as a quartz crystal vibrator X is coupled to an oscillator circuit for producing a high frequency time standard signal. A divider circuit, comprised of a plurality of series-connected divider stages, is adapted to receive the high frequency time standard signal produced by the oscillator circuit, and produce a low frequency timekeeping signal in response thereto. A wave shaper circuit 13 receives the low frequency timekeeping signal and applies, through terminals 16 and 17, pulse signals 180° out of phase with respect to each other, to thereby induce an alternating pulse signal in the drive coil 4.

Specifically, a drive signal having a pulse width of 7.8 m-sec. in duration is applied every two seconds to the input terminals 16 of C-MOS inverter amplifier 14 and, hence, to the input terminal 4*a* of the drive coil 4. Additionally, every two seconds, a driving signal having a pulse width of 7.8 m-sec. duration is applied to input terminal 17 of C-MOS inverter 15, and, hence, to terminal 4*b* of drive coil 4, to thereby alternately induce, in the drive coil 4, a driving pulse of alternating direction to thereby reverse the polarity of the stator poles of the step motor once each second.

Figure 3:
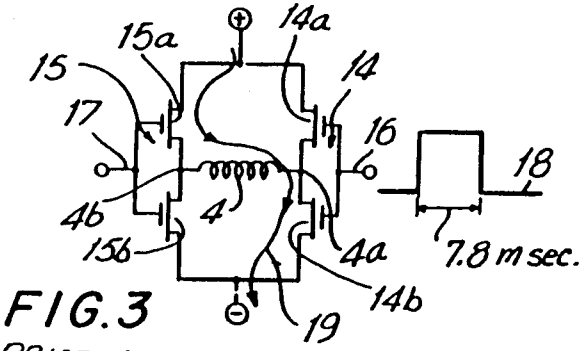
FIG. 3 PRIOR ART
FIG. 3 is a detailed circuit diagram of a step motor driving circuit constructed in accordance with the prior art.

Referring specifically to FIG. 3, a step motor driving circuit, of the type utilized to drive the step motor depicted in FIG. 1, is illustrated. When, for example, a drive signal 18, having a 7.8 m-sec. duration is applied to input terminal 16 of C-MOS inverter 14, a current flow in the direction indicated by the arrowed line 19 is effected from the positive terminal through the transistor 15*a*, drive coil 4, transistor 14*b* and the negative terminal. Alternatively, when a drive signal having a 7.8 m-sec. duration is applied to input terminal 17, a current flow that is symmetrical to the current flow described above, when the drive signal is applied to input terminal 16, is effected. Accordingly, the current flow and, hence, polarity of the pulse signal induced in the drive coil 4 is alternated in response to the pulses of the drive signals being alternately applied to the input terminals 16 and 17 of the driver circuit. If the signals applied to drive coil 4 have a pulse width of 7.8 m-sec. duration, an opposite polarity drive signal, having a pulse duration of 7.8 m-sec., will be alternately induced in the drive coil 4 of the step motor.

In response to each opposite polarity pulse, induced in the drive coil 4, the rotor 1 is stepped through a rotation of 180°. The rotation of the stepmotor is transmitted through a pinion 1*a* to an intermediate wheel 6. The rotation of the intermediate wheel 6 is transmitted through the intermediate wheel pinion 6*a* to the fourth wheel 7 and, hence, thrugh the fourth wheel pinion 7*a* to the center wheel 8 and center wheel pinion 8*a*, which in turn transmits an incremental rotary motion to a cannon-pinion wheel 9. Cannon-pinion wheel 9 advances an hour wheel (not shown), a caleandar mechanism (not shown) and any other wheels that are required to effect the display of time information. The intermediate wheel 6, fourth wheel 7, third wheel 8, cannon-pinion wheel 9, etc., comprise the gear train of the timepiece, and place a load upon the step motor in a conventional manner when the second hand, minute hand, hour hand and calendar display are incrementally rotated thereby.

When a current flow is effected through the drive circuit, depicted in FIG. 3, in the manner indicated by the arrowed line 19, a voltage drop occurs as a result of the channel impedance of the MOS transistor 15*a*, which drop is detected at the terminal 4*b* of the drive coil 4.

Figure 4:
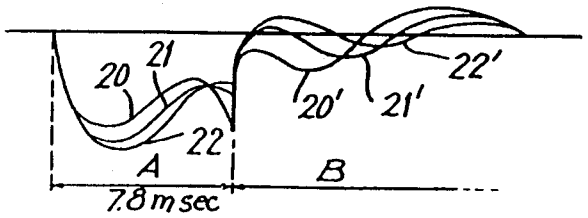
FIG. 4 is a wave diagram illustrating respective drive signals induced in the drive coil of a step motor in response to various load conditions placed thereupon.

An illustration of the form of the drive signal induced in the drive coil 4 in response to the drive signal 18 being applied to input terminal 16, is depicted in FIG. 4. Specifically, the interval A illustrates the current characteristic in the drive coil during the 7.8 m-sec. duration that the driving signal pulse is applied to the input terminal 16, whereafter, the interval B illustrates the current induced in the drive coil once the 7.8 m-sec. pulse drive signal is no longer applied to the input terminal 16. The shape of the wave form, during the interval A, results from currents induced in the drive coil by the rotation of the magnetic rotor, in addition to the current induced in the drive coil 4 as a result of the voltage driving pulse applied thereto. As illustrated in the interval B, the rotor continues to rotate as a result of inertia and to vibrate until the rotor stops at a stable position, thereby causing the fluctuations in the current wave form during the interval B. During the interval B, the P-channel MOS transistors of the C-MOS inverters 14 and 15 are turned ON and, accordingly, the current flow in the drive coil is induced in both directions as a result of the motion of the rotor. The shape and characteristic of the driving current wave form and of the wave form induced in the drive coil differ in accordance with the speed and positioning of the rotor when same is rotated.

The wave forms 20, 21 and 22 in FIG. 4, respectively illustrate the current characteristics of the drive coil 4 when an extremely small or negligible load is placed on the rotor, a medium load is placed on the rotor, and an excessive load is placed on the rotor. The wave forms contained in FIG. 4 illustrate that the greater the load on the rotor, the farther to the right that the current peaks occur. This is a result of the rotor slowing down as the load placed upon the rotor increases. Accordingly, FIG. 4 illustrates that the frequency o the rotor is substantially reduced when the rotor is rotated to its next position in a highly stable manner. Stated otherwise, if the rotor has substantially no load thereupon, the pulse width of the driving signal can be reduced to a duration substantially less than 7.8 m-sec.

Figure 5:
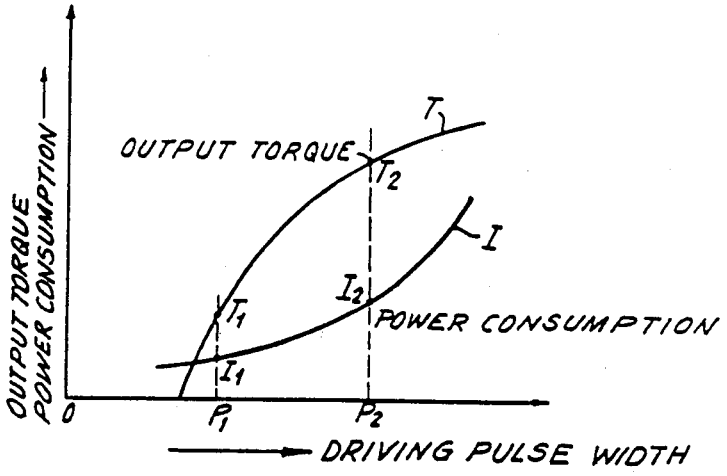
FIG. 5 is a graphical illustration comparing the relationship between the power consumption and output torque of a step motor resulting from changes in the duration of the pulse width of the drive signal applied thereto.

This relationship is illustrated in FIG. 5, wherein changes in the characteristics of the output torque of the rotor T and the power consumption I as a result of changes in duration of the pulse width of the driving signal applied to the drive coil 4 are compared. Specifically, the pulse width duration of 7.8 m-sec. corresponds to $P_2$. Thus, for a pulse width $P_2$, an output torque $T_2$ is obtained with a resulting power consumption $I_2$. Accordingly, the output torque is related to the load placed upon the rotor. If the load on the rotor is small or, in fact, negligible, the output torque needed to effect driving of the drive train can be reduced, thereby resulting in a substantial reduction in power consumption. An output torque $T_1$ is obtained, which is sufficient to drive the rotor when a negligible load is placed thereupon, when a driving signal having a pulse width with a duration $P_1$, is applied and thereby results in power consumption $I_1$. A comparison of the substantially reduced torque $T_1$ and power consumption $I_1$ for a pulse width having a duration $P_1$, when compared with the torque and power consumption for a considerably longer pulse width $P_2$, indicates the clear reduction in power consumption that can be obtained if the pulse width of the drive signal is substantially reduced. To this end, the instant invention is directed to applying a narrow pulse width drive signal to the step motor and for increasing the pulse width of the drive signal when the load placed upon the step motor is increased, to thereby appropriately reduce the power consumption of the electromechanical converter mechanism.

Moreover, as aforenoted, since the load placed upon the rotor for approximately twenty hours a day, when a timepiece utilizes a calendar mechanism, is negligible, a considerable reduction in power consumption is effected if the pulse width of the drive signal is substantially reduced during the twenty hour period. Accordingly, as illustrated in FIG. 5, the rotor can be driven at a pulse width $P_1$ for approximately twenty hours of the day, and at a second pulse width $P_2$ for the other four hours of the day when a greater load is placed upon the rotor by the calender mechanism. If such an approach is utilized, and $I_1/I_2=\frac{1}{2}$, the average reduction in power consumption would be computed as follows:

$$I = \frac{I_1 \times 20 + I_2 \times 4}{24} = \frac{14}{24} I_2 = 0.58\, I_2$$

Figure 2:
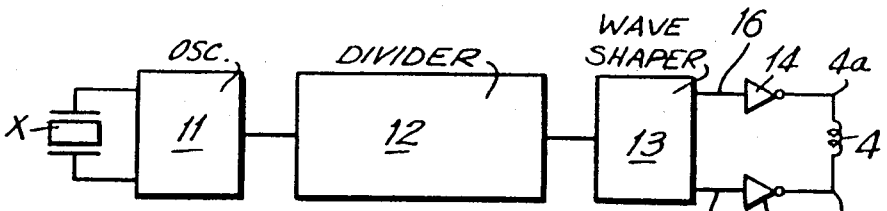
FIG. 2 PRIOR ART
FIG. 2 is a block circuit diagram illustrating the electronic movement of an electronic wristwatch constructed in accordance with the prior art.

The power consumption would be 60% of that obtained by utilizing conventional circuitry of the type depicted in FIGS. 1 through 3, when a pulse width $P_2$, having a 7.8 m-sec. duration, is always utilized as the drive signal.

It is noted that the manner in which the magnitude of the load placed upon the rotor is detected is an important aspect of the instant invention. Specifically, as illustrated in FIG. 4, the wave form of the current signal induced in the drive coil varies as the load placed upon the rotor increases. The positions at which the wave form reach maximum and minimum peaks, during the driving interval A, are shifted to the right and, hence, in duration as the load increases. Although the relative magnitude of the load placed upon the rotor can be detected by utilizing the maximum and minimum current peaks, during the drive interval A, the differences during the driving interval A, are sufficiently small so as to render it difficult to detect the relative differences in magnitude of the load placed upon the rotor. This difficulty is compounded by the fact that the current characteristics will change from rotor to rotor due to mass production techniques, etc.

Accordingly, the instant invention is particularly characterized by the use of the interval B immediately following the drive interval A, which interval is the interval of time immediately following the falling edge of the drive signal 18. It is noted that in the latter interval B, the respective current characteristics illustrate that a minimum peak is reached at a time that is directly related to the load placed upon the rotor. Specifically, the curve 20' illustrates that a minimum peak can first be detected at a time considerably before the minimum current peak 22' when a heavy load is placed upon the rotor. Moreover, the magnitude of difference between relative current minimums, in the after interval B, is considerably larger than the difference between minimum and maximum peaks in the drive interval A. The instant invention detects the magnitude of the load by detecting the induced current wave form in the drive coil 4 after the predetermined pulse of the driving signal is applied thereto. It should also be noted that this relationship between current peaks occurs for any pulse width notwithstanding whether or not the pulse width is extremely narrow, or extremely wide.

Figure 6:
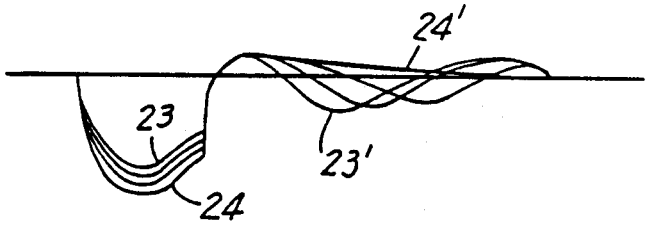
FIG. 6 is a wave diagram illustrating changes in the current induced in the drive coil of a step motor in response to variations in the duration of the pulse width of the drive signal applied thereto.

For example, in FIG. 6, the signals 23 and 24 represent a no-load condition and a maximum-load condition, respectively. It is noted that the same relationship between the current induced during the after interval occurs when the pulse width is shortened, namely, a relative current minimum occurs in current signal 23' when no load is placed on the rotor sooner than it occurs in the current signal 24' in the after interval when the rotor has a large load placed thereupon. Accordingly, in the instant invention, the motor is usually driven by a narrow driving pulse with the assumption made that substantially no load is placed upon the rotor and that the magnitude of the load is always detected in the interval after the drive interval when each of the currents are induced in the drive coil as a result of the rotation of the rotor. Moreover, when an increased load is placed upon the rotor, the instant invention detects this condition, and applies a driving pulse of a longer duration for the period of time that the additional load is placed upon the rotor, after which the narrow pulse width drive signal is, once again, utilized to drive the step motor.

Figure 7:
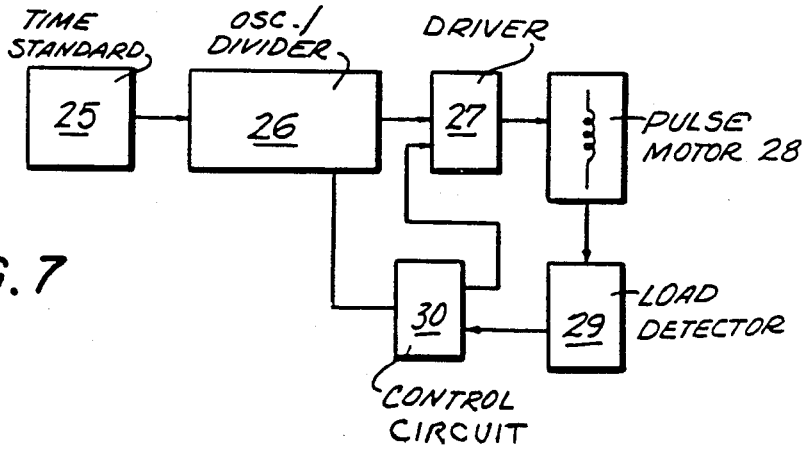
FIG. 7 is a block circuit diagram of an electronic wristwatch constructed in accordance with a preferred embodiment of the instant invention.

Reference is now made to FIG. 7, wherein a block circuit diagram, illustrating the operation of the step motor drive and control circuitry of the instant invention, is depicted. Time standard 25 is coupled to the electronic timepiece circuitry including the oscillator and divider 26, which circuitry applies a low frequency timekeeping signal to the driver 27. The driver 27 applies the alternating pulse signal to the drive coil of pulse motor 28, in a manner discussed in detail above. A load detector circuit 29 is adapted to detect the load placed upon the rotor by detecting the current induced in the drive coil after the drive pulse has been applied to the drive coil of the step motor in the manner explained in detail above. A control circuit 30 is coupled to the load detector circuit 29 and, in response to intermediate frequency signals produced by the divider 26 and a load detection signal produced by load detector 29, which signal is representative of the load placed upon the rotor, control circuit 30 is adapted to control the duration of the pulse width of the drive signal applied to the pulse motor 28. Specifically, in response to detecting a no-load condition on the rotor, the control circuit 30 insures that a narrow drive pulse is applied to the drive coil and, in response to detecting a maximum load upon the rotor, a substantially wider driving pulse is applied to the drive coil of the step motor.

Figure 8:
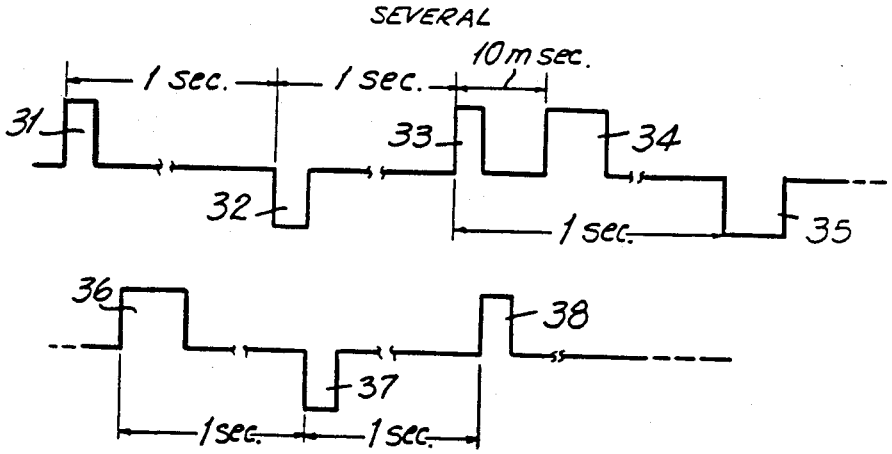
FIG. 8 is a wave diagram illustrating the operation of the electronic wristwatch depicted in FIG. 7.

Reference is now made to FIG. 8, wherein the manner in which the pulse width of the driving signal is controlled by the step motor driving and control circuitry of the instant invention, is depicted. Specifically, the positive and negative going drive pulses 31 and 32 applied across the drive coil 4 each second effect a stepping of the rotor once each second when a small or negligible load is placed upon the rotor. It is noted that the pulse width of the drive pulses 31 and 32 are of a short duration. As aforenoted, after each short duration pulse is applied to the drive coil 4, the magnitude of the load placed upon the rotor is detected. If the narrow pulse width 31 is applied to the rotor, and substantially no load is placed upon the rotor, the rotor will be rotated and, accordingly, the next pulse 32 will have the same narrow pulse width as the pulse width 31. Similarly, after the application of pulse width 32, if substantially no load is placed upon the rotor, the next drive pulse 33 will also be a short duration drive pulse. It is noted, however, that if the load detected after the drive pulse 33 is applied to the drive coil is of a larger magnitude, after a period of ten m-sec. a second positive going drive pulse, having a wider pulse width and being of the same polarity as the narrow pulse width 33, will be applied to the drive coil 4. One second after the leading edge of pulse 33, a second wider pulse 35, of opposite polarity to wider pulse 34, is then applied to the drive coil 4, followed by a further plurality of wider pulses alternately applied to the drive coil, until a larger load is no longer placed upon the rotor, whereafter alternating narrow pulses 37 and 38 will again be applied to the drive coil at one second intervals.

It is noted that when the narrow pulse width 33 is applied to the rotor, and immediately thereafter, it is detected that an increased load has been placed upon the rotor, it is difficult to ascertain if the pulse width of the drive pulse 33 was sufficient to step the rotor. In any event, the increased load placed upon the rotor will clearly cause a current minimum in the induced current in the drive coil to be moved to the right, when reference to FIGS. 4 and 6, and hence detected by the load detection circuitry if the rotor is rotated.

Because the rotor may not be rotated or may be rotated at a slow rate by the application of driving pulse 33 thereto, when the increased load is placed thereupon, it is difficult for the detector circuitry to distinguish whether or not the rotor has been rotated. In any event, by applying a second pulse 34 of wider duration than ten m-sec. after detecting that an increased load is, in fact, placed upon the rotor, if the rotor has already been rotated pulse 34 will have no affect on the rotor since pulse 34 has the same polarity as pulse 33. However, if the increased load placed upon the rotor prevented same from being rotated in response to drive pulse 33 being applied thereto, or slowed down the rotation thereof, the increased duration pulse width will be sufficient to completely rotate the rotor. Accordingly, in the event that the second pulse 34 produced at least ten m-sec. after the first pulse 33 is applied to the drive motor is needed to rotate the rotor, the second hand will be advanced a small portion of a second later. It is noted, however, that the delay of twenty to thirty m-sec's in advancing the second hand will not be perceived by the wearer of the wristwatch. Finally, as indicated above, since the largest load placed upon the rotor in an electroni wristwatch is usually the calendar mechanism, which load is applied for a period of three to four hours, the larger pulse width driving signal is applied to the drive coil for that duration of time, after which the narrow pulse width signals 37 and 38, once again, are applied to the step motor.

It is noted that other conditions that are likely to place an increased load upon the rotor are magnetic fields and/or low temperatures. However, these conditions often last for a short interval and, accordingly, the number of pulses having a longer duration can be limited from a range of ten to thirty seconds to ten to thirty minutes. To this end, the instant invention utilizes a timer in order to measure a predetermined time interval, which timer is explained in detail in the preferred embodiment depicted in FIG. 9.

Figure 9:
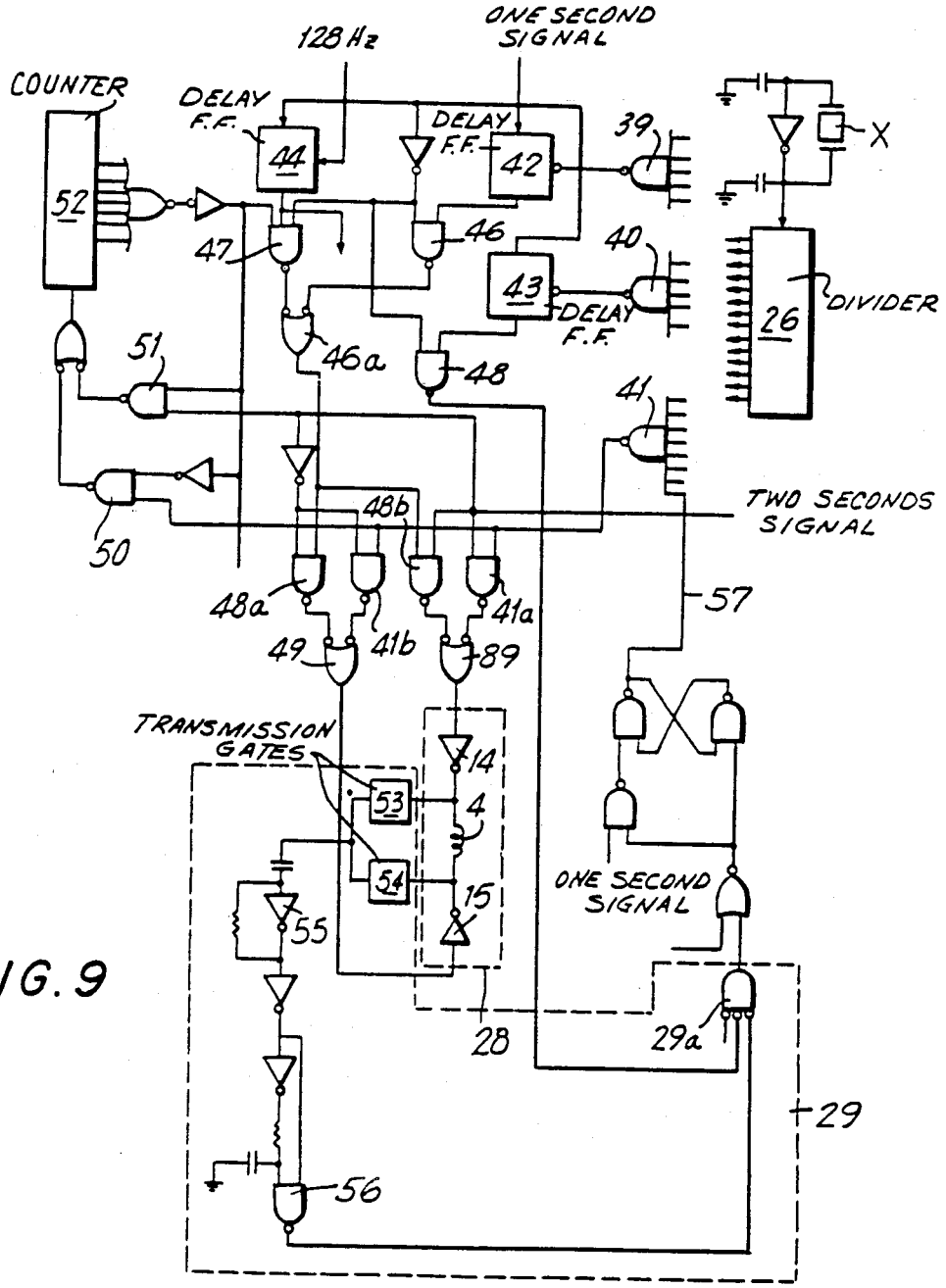
FIG. 9 is a detailed circuit diagram of the electronic wristwatch depicted in FIG. 7.

Turning now to FIG. 9, a detailed circuit diagram of an electronic wristwatch including the step driving and control circuitry of the instant invention is depicted, like reference numerals being utilized to denote like elements depicted above. A quartz crystal vibrator 25 is coupled to an oscillator circuit, for applying a high frequency time standard signal to divider 26. The motor driving circuitry and drive coil is generally indicated as 28. A load detector circuit, generally indicated as 29, is provided for detecting the load placed upon the rotor in order to control the duration of the pulse width applied to the drive coil 4, in a manner to be discussed in greater detail below.

The output of NAND gate 39 is a clock signal and is utilized to shape the narrow pulses that are utilized to drive the motor when a no-load condition is placed thereupon. Specifically, the clock pulse produced at the output of NAND gate 39 is produced once every five m-sec., so that the delay flip-flop 42 produces a five m-sec. signal output every second, so that a pulse signal having a narrow pulse width of five m-sec. is generated at the output of NAND gate 46 and is applied through OR gate 46*a* and NAND gates 48*a* and 48*b* to be applied as drive signals through OR gates 49 and 89 to drive coil 4. Delay flip-flop 44 is adapted to receive a one second signal and, additionally, as a clock input a 128 Hz intermediate frequency signal produced by the divider circuit 26, and in response thereto is adapted to produce an output signal having a pulse width of 7.8 m-sec. once each second that the one second signal is applied thereto. Accordingly, the signal produced at the output of NAND gate 47 is a drive signal having a pulse width of 7.8 m-sec., and is adapted when a heavy load condition is placed upon the rotor to apply through NAND gates 48*a* and 48*b* a driving signal having a pulse width of a longer duration (7.8 m-sec.) to drive the coil 4. NAND gate 40 is adapted to receive intermediate frequency signals produced by the divider circuit 26 and produce a clock signal that is utilized to distinguish between the first unloaded condition and the condition wherein a heavy load is placed upon the rotor. The pulses produced by the NAND gate 40 are utilized to detect the current minimum during the interval after the drive pulse is applied to the rotor. Specifically, the output signals from delay flip-flop 43, which occurs once each second and is gated through NAND gate 48 is applied as a gating input to NAND gate 29*a* of the load detecting circuit in order to effect gating thereby of a load detection signal. Delay flip-flop 43 is controlled in the same manner as the delay flip-flops 42 and 44, by receiving the one second signal as a clock signal.

Figure 10:
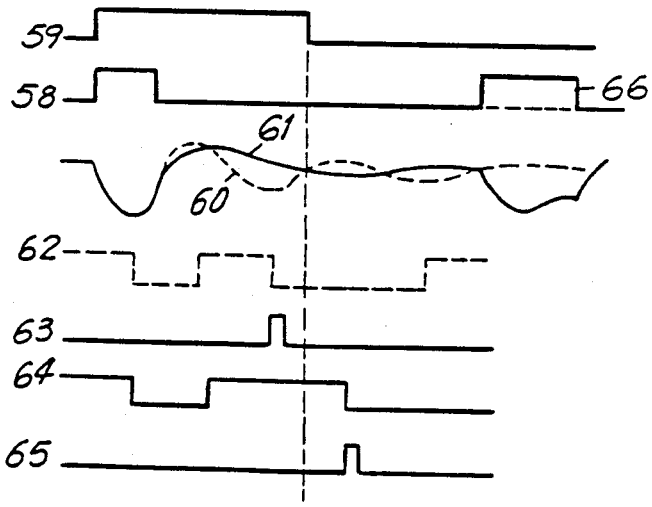
FIG. 10 is a wave diagram illustrating the operation of the electronic wristwatch depicted in FIG. 9.

Referring also to FIG. 10, the signal 58 is a narrow pulse signal produced at the output of NAND gate 46, whereas the signal 59 is the gating signal produced at the output of NAND gate 48. NAND gate 41 is utilized to generate a correction pulse having a pulse width of 7.8 m-sec., and is generated thirty m-sec. after the respective output signals from NAND gates 46 and 47 are produced. The pulse 66 is, therefore, produced at least thirty m-sec. after the falling edge of the gating signal 59. The input terminal 57 controls NAND gate 41 so that the correction signal is produced thereby in a manner described in detail below.

When the correction signal produced at the output of NAND gate 41 is a HIGH level signal, a correction pulse is supplied to NAND gates 41*a*, 41*b* and 50. As aforenoted, the input signals of NAND gates 39, 40 and 41 are the signals utilized to produce a pulse by combining the output of the intermediate frequency signals produced by the divider circuitry. NOR gates 89 and 49 are utilized to supply signals to each of the inverters 14 and 15 of the driving circuit so that an alternating current driving pulse is generated in the drive coil 4 every second. When the HIGH level correction signal is applied at the output of NAND gate 41 to NAND gate 50, counter 52 is reset to zero and placed in a counting mode. When the counter 52 starts to count, the gate 50 is turned OFF until the count of the counter 52, once again, returns to a count of zero. It is noted that when the counter 52 is counting, NAND gate 51 is open so that a two second signal can be applied to the counter in order to effect counting thereby. However, once the counter is indexed to a count of zero, the NAND gate 51 will inhibit the application of the two second signal thereto. Accordingly, as noted above, counter 52 is selected to provide a typical time interval within a range of twenty seconds to thirty minutes, so that same can function as a timer for determining the amount of time that the wider duration 7.8 m-sec. driving pulses should be applied to the drive coil 4. It is noted that NAND gate 47 receives the output of the counter 52 as gating input, and when same is counting, gates the 7.8 m-sec. driving pulse produced by the delay flip-flop 44 during the entire time interval that the counter 52 is not reset to zero.

The detector circuit 29 detects the occurrence of a minimum in the current induced in the drive coil 4 after the driving pulse is applied thereto. Specifically, transmission gates 53 and 54 are respectively coupled to both sides of the drive coil for alternately receiving drive pulses applied to the opposite terminals of the drive coil, in the manner discussed in detail above. The transmission gates receive the respective drive pulses, combine same and apply the combined signals through a capacitor to a differential amplifier 55.

The signals 60 and 61, in FIG. 10, respectively, represent the signals produced at the output of the transmission gates 53 or 54, in response to a no-load condition placed upon the rotor, or a heavy-load condition placed upon the rotor. Accordingly, the differential amplifier operates as a detector and detects the time at which the minimum current peaks occur. A series of inverters receive the output of the differential amplifier 55 and invert same and square same to thereby define the wave form 62 in response to the load signal 60 and the wave form 64 in response to the load signal 61. The NAND gate 56 detects the falling edge of signal 61 after the driving pulse 62 is applied and produces either a pulse 63, when a negligible load is placed upon the rotor, or a pulse 65, when a heavy load is placed upon the rotor. When the pulse 63 occurs during the duration of the gating signal 59, a no-load condition is detected. However, when pulse 65 occurs after the falling edge of the gating signal 59, it results in the NAND gate 29*a* of load detecting circuit producing a load detection signal representative of a heavy load condition placed upon the rotor.

Accordingly, a correction pulse 66 is applied to the timing circuitry when the signal 61, representative of a heavy load, is detected. As noted above, even if the rotation of the rotor is completed before the correction pulse 66 is produced as a result of a heavy load condition, the correction pulse is applied through AND gate 50 to the counter 52 to open the NAND gate 51 and permit the counter 52 to begin counting. Once the counter begins counting, NAND gate 51 remains open, so that the driving signal having a 7.8 m-sec. duration pulse width is continuously applied to the motor driving circuit 28 until the counter completes an entire counting cycle and no further correction pulses are being applied to NAND gate 50.

Accordingly, the instant invention is particularly characterized by the use of a counter for insuring that for at least a predetermined interval of time, such as ten to twenty seconds, a driving signal having a pulse of longer duration is applied to the step motor in order to insure that enough torque is imparted to the rotor to drive the additional load placed thereupon. Moreover, if the load detecting circuitry continues to detect the presence of a heavy load condition upon the rotor, the signal 66 will continue to be applied to the counter 52 and thereby effect continuous gating of the 7.8 m-sec. drive signal until the heavy load is removed from the rotor, whereafter a narrow pulse width drive signal will immediately be applied thereto.

Figure 18:
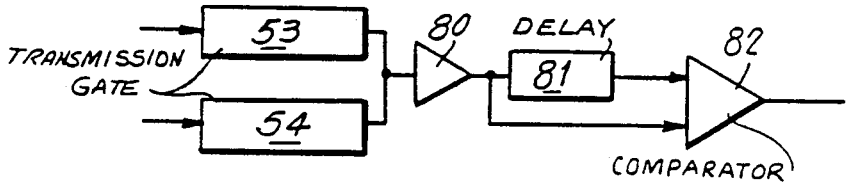
FIG. 18 is a block circuit diagram of a peak detecting circuit constructed in accordance with the preferred embodiment of the instant invention.

Reference is now made to FIG. 18, wherein a block circuit diagram of another peak detecting circuit, particularly suitable for use with the instant invention, is depicted, like reference numerals being utilized to denote like elements depicted above. Transmission gates 53 and 54 receive the drive signals applied to both sides of the drive coil 4, and apply same to an amplifier 80, which amplifier is substituted in place of the differential amplifier 55 described above with respect to FIG. 9. A delay circuit receives the output of the amplifier 80 delay same and applies the delayed output as a first input of a comparator 82. Additionally, the output of the amplifier 80 is directly applied to the comparator 82, which comparator compares the respective outputs and provides a load detection signal when the minimum peak current is delayed after the driving pulse has been applied to the drive coil, as a result of a heavy load being placed upon the rotor.

Referring now to FIGS. 13 and 14, detailed circuit diagrams of the amplifier 80, depicted in FIG. 18, are respectively illustrated. In FIG. 13, the transmission gates 53 and 54 are coupled through a resistor 66 to a C-MOS inverter circuit including a resistance disposed between the input of the inverter and a reference terminal such as ground. Similarly, in FIG. 14, the output terminal 68 of the C-MOS inverter is applied to an output detector 70, which output detector is coupled to the gate electrode of an MOS transistor, to thereby utilize the forward saturation resistance thereof in place of the resistance element 67. Accordingly, the drive signals 23 and 24, illustrated in FIG. 6, that are detected by the detection circuitry usually have a voltage level between several mV and several tens of mV. In FIG. 13, the resistors 66 and 67 operate as a voltage divider in order to convert the drive signal applied to the transmission gate to a level to be detected by the C-MOS inverter circuit so that the signal 76, illustrated in FIG. 16, is produced in response to a particular load condition being placed upon the rotor. In FIG. 14, by utilizing the channel resistance of the MOS transistor 69, and controlling same by the use of an output detector coupled to the output terminal 68 of the C-MOS inverter, a more sensitive detection control is obtained.

Reference is also made to FIG. 15, wherein a detailed circuit diagram of the delay circuit 81 is depicted, like reference numerals being utilized to denote like elements described above. Accordingly, the output terminal 68 of the amplifier 80 is coupled to series-connected transmission gates 71 and 73, which transmission gates are separated by load capacitors 72 and, if necessary, 74. By utilizing the delay circuitry depicted in FIG. 15, the output signal produced at the output terminal 68 of the amplifier 80 is delayed and produced at the output terminal 75 of the delay circuit as the dashed signal 77 depicted in FIG. 16.

Figure 17:
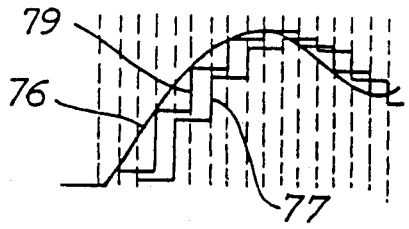
FIG. 17 is a model wave diagram of the wave form illustrated in FIG. 16.

The wave forms 76 and 77 depicted in FIG. 16 are illustrated in FIG. 17 in a model diagram. The input signal 76 is applied through transmission gate 71 to the transmission gate 73 and, hence, capacitor 74 so that both the signal 76 and the delayed signal 77 are applied to the comparator 82. Accordingly, when the signals 76 and 77 are applied to the comparator, the rectangular detection signal 78 is produced at the output thereof in response thereto. It is noted that a bucket brigade delay circuit can be utilized instead of the delay circuit depicted in FIG. 15 because of the relatively low frequency of the input signal.

Figure 19:
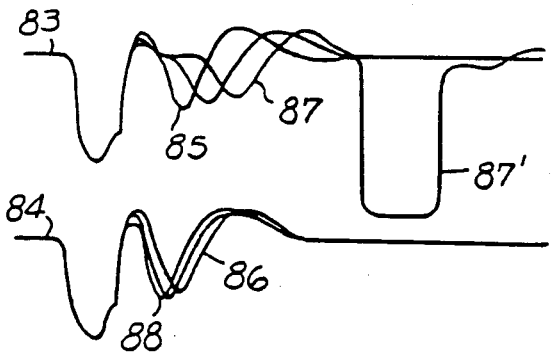
FIG. 19 is a wave diagram illustrating the variations in the current induced in the drive coil when drive signals, of the type to which the instant invention is directed, are applied to the step motor.

Turning now to FIG. 19, current wave forms that are detected in response to the application of a DC magnetic field to the drive coil of the rotor, are depicted. The wave form 83 is produced when the magnetic field, utilized to drive the rotor, is opposite to the orientation of the magnetic flux field in the poles of the motor. The wave form 84 occurs when the magnetic fields in the stator poles are in the same direction as the magnetic fields in the driving coil. The difference between the levels of the magnetic fields of wave forms 85 and 86 is minimal and, hence, they can be regarded as substantially identical wave forms. It is noted, however, that the wave forms 87 and 88 are produced when the exterior magnetic field reaches a level of 40 Gauss. The stronger the exterior magnetic field, the slower the response of the wave form 87 and the wave form 83 as a result of the action placed on the magnetic field as a result of a large load being placed upon the step motor. Accordingly, in an electronic wristwatch constructed in accordance with the instant invention, the effects of the magnetic field surrounding the step motor have been experimentally confirmed to be the same as those found in a conventional electronic wristwatch. Thus, for the wave form 87, depicted in FIG. 19, by utilizing the correction signal 87', to the standard pulse, it is readily apparent that the shockproof feature is utilized to advantage therein.

Figure 11:
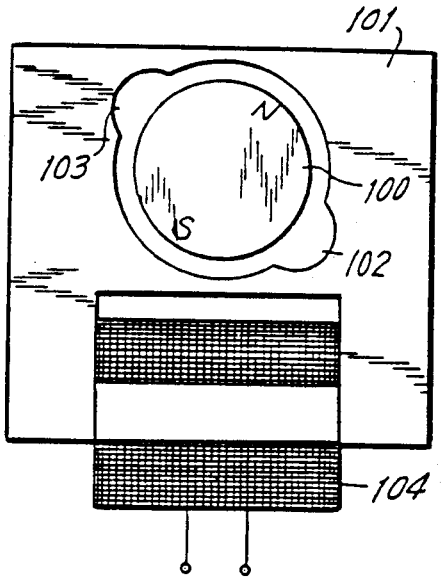
FIG. 11 is a plan view of a step motor constructed in accordance with an alternative embodiment of the instant invention.
Figure 12:
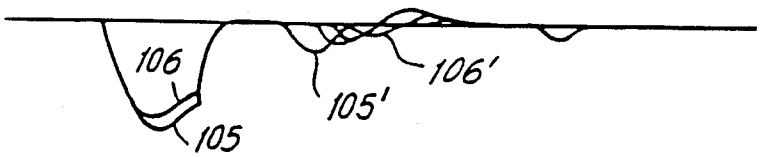
FIG. 12 is a wave diagram illustrating the current induced in the drive coil of the step motor depicted in FIG. 11.

It is noted that the instant invention is not limited to an electro-mechanical converter mechanism including the step motor depicted in FIG. 1. For example, the step motor depicted in FIG. 11 is particularly suitable for use in the instant invention. It is further noted that a single stator plate 101, having no gap between the respective facing stator poles is utilized, with notches 102 and 103 being utilized to fix a static position of the rotor and insure that same is properly oriented to be rotated in a particular direction in response to the driving pulses being applied to the drive coil 104 thereof. The use of a one-piece stator plate 101 and notches 102 and 103 surrounding the rotor 100, causes a different current to be induced in the drive coil after driving than the current induced by the step motor depicted in FIG. 1. Specifically, when no load is placed upon the rotor, the signal 105, depicted in FIG. 12, represents the current induced in the drive coil in response to driving, and the wave form 105' represents the current induced in the drive coil upon completion of the rotor being rotated. Similarly, wave form 106 illustrates the current induced in the rotor during driving with the portion 106' thereof representing the current induced in the drive coil at the completion of the drive signal, when a heavier load is placed upon the rotor. In any event, FIG. 12 illustrates that the relative current minimums of the signals 106 and 105 clearly occur at different times as a result of the load placed upon the rotor, and hence are readily detected in order to be utilized to control the duration of the pulse width of the drive signal applied to the step motor to effect driving of same.

It will thus be seen that the objects set forth above, among those made apparant from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An electronic timepiece having a step motor and comprising a quartz crystal vibrator producing a high frequency time standard signal, divider circuit means for producing low-frequency time signals in response to said high frequency time standard signals; a gear train driven by said step motor and adapted to place the step motor in one of a first normally loaded condition and a second loaded condition; load detection means for producing a load detection signal in response to detecting said second loaded condition of said step motor; driving and control means intermediate said divider circuit means and said step motor for receiving the low frequency signal from the dividing circuit means, said driving and control means being adapted to apply a first drive signal having a first pulse shape to said step motor during a predetermined unit of time defining the period of the first pulse to said step motor in response to said low frequency signal, said driving and control means, in response to said load detection signal being applied thereto, being adapted to apply a second drive signal having a second pulse shape of larger energy than said first pulse shape to said step motor, said step motor including drive coil means for receiving said first drive signal produced by said driving and control means, said load detecting means being adapted to detect induced current in said coil means after said first drive signal is applied thereto, said driving and control means, in response to said load detection signal being applied thereto, being adapted to apply the second drive signal having a second pulse shape of the same polarity as said first pulse shape to said drive coil means, said second pulse being applied during said predetermined unit of time.

2. An electronic timepiece having a step motor and comprising a quartz crystal vibrator producing a high frequency time standard signal, divider circuit means for producing low-frequency time signals in response to said high frequency time standard signals; a gear train driven by said step motor and adapted to place the step motor in one of a first normally loaded condition and a second loaded condition; load detection means for producing a load detection signal in response to detecting said second loaded condition of said step motor; driving and control means intermediate said divider circuit means and said step motor for receiving the low frequency signal from the dividing circuit means, said driving and control means being adapted to apply a first drive signal having a first pulse shape to said step motor during every predetermined unit of time, each predetermined unit of time defining the period of the first pulse to said step motor in response to said low frequency signal, said driving and control means, in response to said load detection signal being applied thereto, being adapted to apply a second drive signal having a second pulse shape of larger energy than said first pulse shape to said step motor, said step motor including drive coil means for receiving said first drive signal produced by said driving and control means, said load detecting means being adapted to detect induced current in said coil means after said first drive signal is applied thereto, said driving and control means, in response to said load detection signal being applied thereto, being adapted to apply the second drive signal having a second pulse shape of the same polarity as said first pulse shape to said drive coil means, said second pulse being applied during said predetermined unit of time.

* * * * *